US010875680B2

(12) United States Patent
Unger et al.

(10) Patent No.: US 10,875,680 B2
(45) Date of Patent: Dec. 29, 2020

(54) CLOSURE CAP FOR A SUBSTANTIALLY CYLINDRICAL VESSEL

(71) Applicant: Morlo Gesellschaft mit beschraenkter Haftung, St. Ingbert (DE)

(72) Inventors: Michael Unger, Spiesen-Elversberg (DE); Wolfgang Unger, Spiesen-Elversberg (DE)

(73) Assignee: Morlo Gesellschaft Mit beschraenkter Haftung, St. Ingbert (DE)

( * ) Notice: Subject to any disclaimer, the term of this patent is extended or adjusted under 35 U.S.C. 154(b) by 220 days.

(21) Appl. No.: 15/304,140

(22) PCT Filed: Apr. 15, 2015

(86) PCT No.: PCT/DE2015/100157
§ 371 (c)(1),
(2) Date: Oct. 14, 2016

(87) PCT Pub. No.: WO2015/158331
PCT Pub. Date: Oct. 22, 2015

(65) Prior Publication Data

US 2017/0036811 A1 Feb. 9, 2017

(30) Foreign Application Priority Data

Apr. 15, 2014 (DE) ..... 10 2014 105 403

(51) Int. Cl.
*B65D 41/62* (2006.01)
*B65D 21/02* (2006.01)
*B65D 41/32* (2006.01)

(52) U.S. Cl.
CPC ..... *B65D 21/022* (2013.01); *B65D 41/32* (2013.01); *B65D 41/62* (2013.01)

(58) Field of Classification Search
CPC ..... B65D 21/022; B65D 41/32; B65D 41/62; B65D 23/08; B65D 23/085; B65D 25/205
(Continued)

(56) References Cited

U.S. PATENT DOCUMENTS 2,670,076 A 2/1954 Monks
3,583,596 A * 6/1971 Brewer ..... B65D 43/0212 220/781
(Continued)

FOREIGN PATENT DOCUMENTS

DE 20 57 901 A1 6/1972
FR 1 084 101 A 1/1955
(Continued)

OTHER PUBLICATIONS

International Search Report of PCT/DE2015/100157, dated Jul. 8, 2015.

*Primary Examiner* — Don M Anderson
(74) *Attorney, Agent, or Firm* — Collard & Roe, P.C.

(57) ABSTRACT

The invention relates to a closure cap for a substantially cylindrical vessel, with a lateral surface, a closed end and an open end, and with a tear-open strip having a grip tab for opening the closure cap.
In order to produce closure caps which are designed such that they can be applied by machine to substantially cylindrical vessels, it is proposed within the context of the invention that the lateral surface is substantially cylindrical, at least in the area of the open end, and that the closure cap is of stackable design and has means for stacking at least two closure caps with defined spacing.
The invention is based on the finding that, for cost reasons, it is useful if also closure caps for substantially cylindrical vessels can be stacked, i.e. pushed onto one another, during transport as they then take up less space. In the case of machine-applied closure caps, too, it is advantageous to
(Continued)

stack the caps, since the machine can then collect them more easily and prior positioning of the closure cap is superfluous.

13 Claims, 3 Drawing Sheets

(58) Field of Classification Search
USPC ..... 215/206, 200, 250
See application file for complete search history.

(56) References Cited

U.S. PATENT DOCUMENTS

| | | | | | |
|---|---|---|---|---|---|
| 4,275,815 | A * | 6/1981 | Davis | B65D 21/0219 206/508 |
| 4,877,151 | A * | 10/1989 | Rush | B29C 51/346 206/514 |
| 2015/0090625 | A1 | 4/2015 | Bauss | |

FOREIGN PATENT DOCUMENTS

| | | | |
|---|---|---|---|
| GB | 1 118 950 | A | 7/1968 |
| GB | 1 353 503 | A | 5/1974 |
| WO | 2013/167701 | A1 | 11/2013 |

* cited by examiner

CLOSURE CAP FOR A SUBSTANTIALLY CYLINDRICAL VESSEL

CROSS REFERENCE TO RELATED APPLICATIONS

This application is the National Stage of PCT/DE2015/100157 filed on Apr. 15, 2015, which claims priority under 35 U.S.C. § 119 of German Application No. 10 2014 105 403.2 filed on Apr. 15, 2014, the disclosure of which is incorporated by reference. The international application under PCT article 21(2) was not published in English.

The invention relates to a closure cap for a substantially cylindrical vessel, with a lateral surface, a closed end and an open end, and with a tear-open strip having a grip tab for opening the closure cap, the lateral surface being substantially cylindrical at least in the area of the open end and the closure cap being of stackable configuration and having means for stacking at least two closure caps with defined spacing.

DE 20 57 901 A1 describes a bottle top of this kind made of plastic shrink-wrap film, which is pre-shrunk into the usual conical shape and shrunk onto a bottle. The bottle top has spacers that project on the outside of its lateral surface.

The WO 2013/167701 A1 discloses a closure element for a vessel, which comprises a closure cap having a lateral surface, a closed end and an open end, a tear-open strip having a grip tab for opening the closure cap and a closure label. This closure element serves as initial-opening protection for original packaging containing high-quality products, such as medicinal products, drugs, food, cosmetics and spare parts for machines, in order to prevent the vessel from being refilled with a copy, in most cases a cheap me, after the contents have been removed.

In the case of numerous high-quality products, such as drugs, it is not possible to use a cap that shrinks under the influence of heat (shrink-on cap) because of their heat sensitivity. Furthermore, the vessel could be closed again with a cap after refilling it with a copy, meaning that no effective protection against fake products is achieved. For this reason, the WO 2013/167701 suggests providing the vessel with a closure cap that is not connected to the vessel by the influence of heat but by means of a label, the first part of which is located on the vessel and the second part of which is located on the closure cap. When the vessel is opened, both the closure cap and the label are destroyed.

On account of the vessel's tolerances, it is difficult to engineer closure caps in such a way that they may be applied unproblematically also to substantially cylindrical vessels, both at the lower and at the upper tolerance limit.

The objective of the present invention is thus to create closure caps that are configured in such a way that they can be applied by machine to substantially cylindrical vessels, the closure caps not being fixed to the vessel as a result of the influence of heat but by means of a label, the first portion of which is located on the vessel and the second portion of which is located on the closure cap, and both the closure cap and the label being destroyed when the vessel is opened.

This objective is achieved according to the invention by configuring the stacking means as a bead located in the area of the open end of the closure cap, perpendicular to the axis thereof and oriented towards the interior thereof.

The invention is based on the finding that, for cost reasons, it is useful if also closure caps for substantially cylindrical vessels can be stacked, i.e. pushed into one another, during transport as they then take up less space. For machine application of closure caps, too, it is advantageous to stack the caps, since the machine can then collect them more easily and prior positioning of the closure cap is superfluous.

Although intended for use on substantially cylindrical vessels, the closure caps according to the invention are therefore stackable, i.e. they can be pushed, at least partially, into each other. The closure caps may be rendered stackable in different ways, for example by slight tapering of the closure caps substantially cylindrical lateral surface in the area of the open end, the taper ratio being 1:50 to 1:30, preferably 1:40. The closure caps are pushed into one another in the area of the open end, this being possible thanks to a conical shape of such kind. Depending on the vessel's design, it is also possible to configure a first, substantially cylindrical, portion of the closure cap such that it has a smaller diameter than another, likewise substantially cylindrical, portion of the closure cap, enabling the portion with the lesser diameter to be pushed into that portion of the adjacent closure cap that has the greater diameter.

For machine application of the closure caps, means are provided for stacking at least two closure caps with defined spacing, thereby ensuring that the closure caps are supplied with defined mutual spacing to the machine.

This bead is thus configured as an indentation in the closure cap. It limits the distance to which the adjacent closure cap can be inserted into it and thus ensures that the closure caps are spaced apart in each case by the desired defined distance. Depending on the requirements, the bead may be located close to the open end of the closure cap or further away from it.

In this context it is possible for the bead to run around the full circumference of the closure cap or to run around a portion of the closure cap's circumference.

It was found within the framework of the invention that the bead need not fully encircle the closure cap but may also be interrupted.

It may be advantageous to provide a plurality of mutually parallel beads, in particular two parallel beads.

The beads not only have the function of ensuring a defined distance between the stacked closure caps but also serve to compensate for tolerances in the vessel's diameter and to reinforce the closure cap in the area of its open end. It may accordingly be expedient to provide the closure cap with two or more beads.

According to a second embodiment of the invention, the stacking means is configured as a shoulder on the closure cap, on which the adjacent closure cap rests.

A shoulder, i.e. an increase or a decrease in the diameter of the closure cap, is another means of stacking the closure caps with defined spacing.

In this context it is both possible for the inserted portion of a first closure cap which, for stacking purposes, is partially inserted into a second closure cap, to rest on the shoulder or for the pushed-on portion of a first closure cap which, for stacking purposes, is partially pushed onto a second closure cap, to rest on the shoulder.

A refinement of the invention consists in that the closure cap has an anti-twist means.

It may namely be necessary not only for the closure caps to be stacked at a defined distance apart from each other but also for them to be in a particular rotary position, for example on account of the position of the tear-open tab or the position of any lettering or marking relative to the label. The anti-twist means ensures that the stacked closure caps are supplied in the desired rotary position.

This may be achieved, for example, by configuring the anti-twist means as a form-fit connection between two closure caps.

To this end it is possible, for example, to configure a portion of the closure cap, which, in the stacked state, engages in a portion of the adjacent closure cap, such that it is not rotationally symmetric but has a different shape, thereby ensuring that the closure caps, on being stacked, assume a defined rotational position.

A refinement of the invention consists in that the closure cap has inwardly oriented knobs in the area of its open end.

It is also possible for the closure cap to have, in the area of its open end, inwardly oriented beads running parallel to the closure cap's axis.

Both the knobs and the beads running parallel to the closure cap's axis serve to compensate for tolerances in the vessel's diameter and to reinforce the closure cap in the area of its open end.

Finally, the scope of the invention makes provision for the closure cap to have a perforation in the area of its closed end for deaerating the inside of the closure cap.

This facilitates the escape of air contained in the closure cap when the closure cap is applied to a vessel.

Embodiments of the invention are explained below in more detail by reference to drawings.

The drawing in

Figure 1:
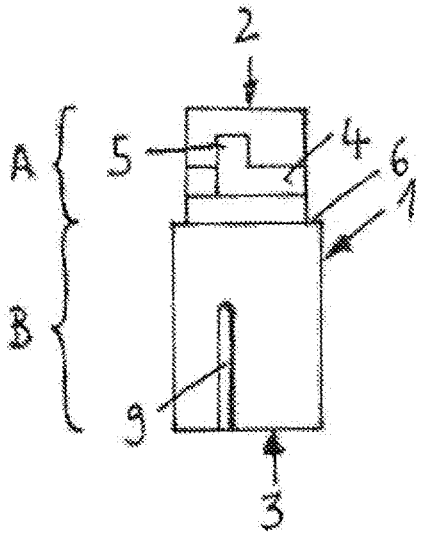
FIG. 1 shows a side view of a first closure cap according to the invention.

As shown in FIG. 1, the closure cap 1 has a lateral surface, a closed end 2 and an open end 3, as well as a tear-open strip 4 having a grip tab 5 for opening the closure cap 1. At least part of the lateral surface is cylindrical in order to cover a substantially cylindrical vessel.

The closure caps 1 may be rendered stackable in different ways, for example by slight tapering of the closure caps 1, at least in the area in which they are pushed onto one another. The taper ratio is 1:50 to 1:30, preferably 1:40. Depending on the vessel's design, it is also possible to configure a first, substantially cylindrical, portion of the closure cap 1 such that it has a smaller diameter than the other substantially cylindrical portion of the closure cap, enabling the portion with the lesser diameter to be pushed into that portion of the adjacent closure cap that has the greater diameter.

The closure cap 1 shown in FIG. 1 is stackable in spite of its cylindrical shape, this being achieved here in that the closure cap 1 has a first cylindrical portion A with a diameter A and connects with a second cylindrical portion with a diameter B. A shoulder 6 is formed in consequence of this difference in diameters. The first portion A is applied to the lid of the vessel and the second portion B surrounds a portion of the vessel itself.

Figure 2:
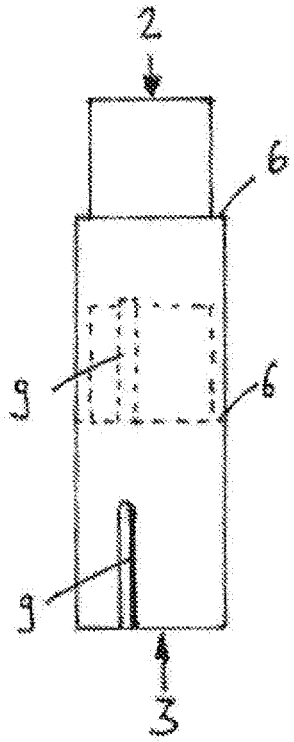
FIG. 2 shows a side view of two stacked closure caps according to FIG. 1.

When the closure caps 1 are stacked, the adjacent closure cap 1 rests on the shoulder 6 of the closure cap 1, as shown in FIG. 2.

Figure 3:
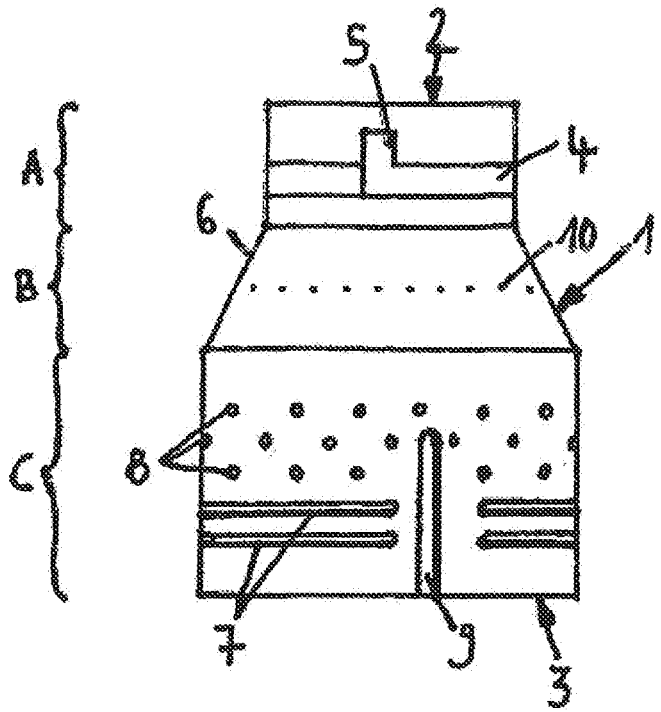
FIG. 3 shows a side view of a second closure cap according to the invention.

The closure cap 1 according to FIG. 3 has a first cylindrical portion A, which has a first diameter. This first portion of the closure cap 1 is positioned on the lid of a vessel. The first portion A connects with a second portion B, which is conical and which opens into a third, cylindrical portion C, which has a larger diameter than the first portion A. This third portion C surrounds part of the vessel itself and has a slight taper of 1:40, enabling the closure caps 1 to be pushed into each other in this portion C.

This closure cap 1 is provided with means for stacking at least two closure caps with defined spacing. The means may be configured as a bead 7 disposed in the area of the closure cap's open end 3. The bead 7 runs perpendicular to the axis of the closure cap 1 and is oriented towards the interior thereof. The bead 7 may run around the full circumference of the closure cap 1 or extend only around a portion of the circumference of the closure cap 1, as is the case in FIG. 3. It is possible to provide a plurality of mutually parallel beads 7, in particular two parallel beads 7, as in FIG. 3.

Figure 4:
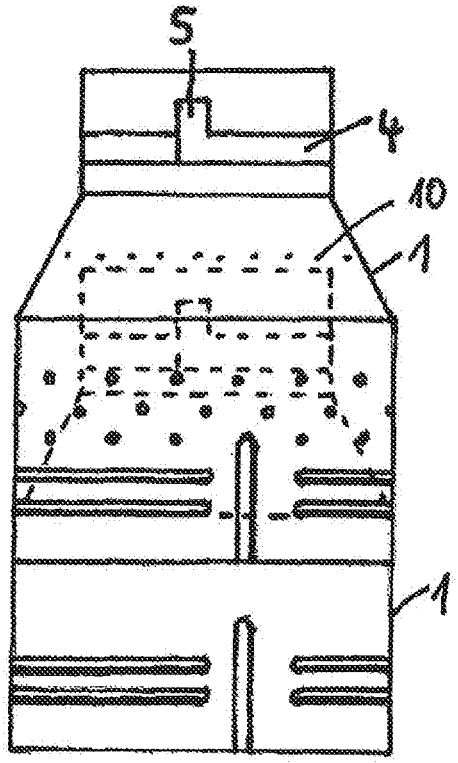
FIG. 4 shows a side view of two stacked closure caps according to FIG. 3.

FIG. 4 shows two stacked closure caps 1, the second of which has been pushed as far as its first bead 7 into the first closure cap 1. The first bead 7 thus ensures that the stacked closure caps 1 are spaced apart by a defined distance.

It may be advantageous for the closure cap 1 to have an anti-twist means, which may be configured, for example, as a form-fit connection between two closure caps.

The closure cap 1 may also have inwardly oriented knobs 8 in the area of its open end 3. Alternatively, or in addition, the closure cap 1 may have, in the area of its open end 3, inwardly oriented beads 9 running parallel to the closure cap's axis. Both variants are shown in FIG. 3.

The closure cap 1 may also have a perforation 10 in the area of its closed end for deaerating the inside of the closure cap 1.

Figure 5:
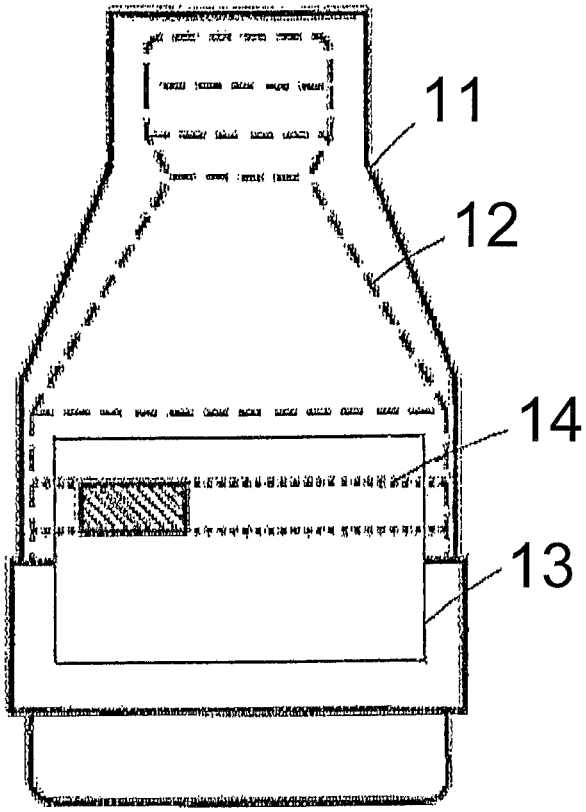
FIG. 5 shows a side view of a third closure cap according to the invention.

FIG. 5 shows a side view of a third closure cap according to the invention. FIG. 5 shows a closure cap being fixed to the vessel with a label. In this FIG. 5, reference 11 refers to the closure cap, reference 12 refers to the vessel, reference 13 refers to the label and reference 14 refers to the tear-open strip.

The invention claimed is:

1. A closure cap for a substantially cylindrical vessel with a lid, with a lateral surface, a closed end and an open end, and with a tear-open strip having a grip tab for opening the closure cap, wherein the closure cap has a first cylindrical portion with a first diameter to be applied to the lid of the vessel which is followed by a second conical portion which itself is followed by a third cylindrical portion with a larger diameter than the first portion to surround a portion of the vessel itself, the lateral surface being substantially cylindrical at least in the area of the open end, wherein the closure cap is of stackable configuration and has means for stacking at least two closure caps with defined spacing, wherein the stacking means comprises a first bead configured as an indentation indented toward an interior of the third cylindrical portion of the closure cap, the indentation running perpendicular to the axis of the third cylindrical portion, and wherein the closure cap is applied to the substantially cylindrical vessel and the lid without being influenced by heat.

2. The closure cap according to claim 1, wherein the first bead runs around the entire circumference of the closure cap.

3. The closure cap according to claim 1, wherein the first bead runs around a portion of the circumference of the closure cap.

4. The closure cap according to claim 1, further comprising a second bead parallel to the first bead.

5. The closure cap according to claim 1, wherein the closure cap has an anti-twist means.

6. The closure cap according to claim 5, wherein the anti-twist means is configured as a form-fit connection between two closure caps.

7. The closure cap according to claim 1, wherein the closure cap has inwardly oriented knobs in the area of the open end.

8. The closure cap according to claim 1, wherein the closure cap has, in the area of the open end, inwardly oriented reinforcing beads separate from the first bead and running parallel to the axis of the closure cap.

9. The closure cap according to claim 1, wherein the closure cap has a perforation in the area of the closed end for deaerating the inside of the closure cap.

10. A closure cap for a substantially cylindrical vessel with a lid, with a lateral surface, a closed end and an open end, and with a tear-open strip having a grip tab for opening the closure cap, wherein the closure cap has a first cylindrical portion with a first diameter to be applied to the lid of the vessel which is followed by a second conical portion which itself is followed by a third cylindrical portion with a greater diameter than the first portion to surround a portion of the vessel itself, a conical shoulder being formed in consequence of this difference in diameters, the lateral surface being substantially cylindrical in the area of the open end, wherein the closure cap is of stackable configuration and the conical shoulder forms a means for stacking the closure cap with an adjacent closure cap defined spacing, wherein the adjacent closure cap rests on this conical shoulder, wherein the means for stacking further comprises a first bead configured as an indentation indented toward an interior of the third cylindrical portion of the closure cap, the indentation running perpendicular to the axis of the third cylindrical portion, and wherein the closure cap is applied to the substantially cylindrical vessel and the lid without being influenced by heat.

11. The closure cap according to claim 10, wherein a portion of the adjacent closure cap, for stacking purposes, is partially pushed onto the closure cap.

12. A substantially cylindrical vessel with a lid and being provided with a closure cap, the closure cap having a lateral surface, a closed end and an open end, and with a tear-open strip having a grip tab for opening the closure cap, wherein the closure cap has a first cylindrical portion with a first diameter being applied to the lid of the vessel followed by a second conical portion which itself is followed by a third cylindrical portion with a second diameter greater than the diameter of the first portion surrounding a portion of the vessel itself, a conical shoulder being formed in consequence of this difference in diameters, the lateral surface being substantially cylindrical in the area of the open end and wherein the closure cap is of stackable configuration and has means for stacking at least two closure caps with defined spacing, wherein the stacking means comprises a first bead configured as an indentation indented toward an interior of the third cylindrical portion of the closure cap, the indentation running perpendicular to the axis of the third cylindrical portion, and wherein the closure cap is applied to the substantially cylindrical vessel and the lid without being influenced by heat.

13. The substantially cylindrical vessel of claim 12, characterized in that the closure cap is fixed to the vessel by means of a label, the first portion of which is located on the vessel and the second portion of which is located on the closure cap, and both the closure cap and the label being destroyed when the vessel is opened.

* * * * *